United States Patent [19]

Mosky et al.

[11] 4,144,647

[45] Mar. 20, 1979

[54] TECHNIQUES FOR THE MANUFACTURE OF GARMENTS AND APPARATUS FOR USE THEREIN

[76] Inventors: Nicolas Mosky, 7, rue Paradis; Jean Gay, 15, rue Rouget de l'Isle; Paul Vigneau, 195, Bd de la Madeleine, all of 06000 Nice, France

[21] Appl. No.: 771,108

[22] Filed: Feb. 23, 1977

[30] Foreign Application Priority Data

Feb. 25, 1976 [FR] France ..... 76 05203

[51] Int. Cl.[2] ..... A41H 3/06

[52] U.S. Cl. ..... 33/12; 33/17 R

[58] Field of Search ..... 33/12, 11, 17 A, 17 R, 33/13

[56] References Cited

U.S. PATENT DOCUMENTS 932,870 8/1909 Kasralowicz ..... 33/12

1,616,080 2/1927 Freedman ..... 33/12

FOREIGN PATENT DOCUMENTS 830226 7/1938 France ..... 33/12

303150 1/1955 Switzerland ..... 33/12

710354 6/1954 United Kingdom ..... 33/12

*Primary Examiner*—Richard E. Aegerter

*Assistant Examiner*—Willis Little

[57] ABSTRACT

The assembly of articles of wearing apparel, particularly from fabric bearing a design, is facilitated by establishing reference markings along at least two adjacent sides of a length of material. Patterns, which include intersecting perpendicular guide lines, are positioned on the length of material employing a positioning plan which establishes a relationship between the guide lines and reference markings commensurate with the desired appearance of the garment being produced.

11 Claims, 7 Drawing Figures

TECHNIQUES FOR THE MANUFACTURE OF GARMENTS AND APPARATUS FOR USE THEREIN

BACKGROUND OF THE INVENTION (1) Field of the Invention

The present invention relates to wearing apparel and particularly to patterns for use in the making of garments. More specifically, this invention is directed to a technique for the assembly of garments and especially to a method which facilitates the cutting of material for use in the assembly of articles of wearing apparel. Accordingly, the general objects of the present invention are to provide novel and improved articles and methods of such character.

(2) Description of the Prior Art

In the making of a garment, a length of material and patterns corresponding to the different pieces of the garment are employed. The patterns are placed on the length of material, the material is cut along the edges of the patterns and the pieces of material thereby obtained are subsequently joined together to form the garment. While this procedure appears to be uncomplicated, in actual practice considerable skill and knowledge of cutting is required; this being particularly true when the fabric is one having a design printed thereon. Many fabrics have designs which are not symmetrically disposed thereon and the full stylishness of a garment produced from such fabric often depends on the manner in which the material has been cut so as to obtain a particular positioning of portions of the designs when the garment is assembled. It is very difficult for a person who is not an expert to visualize, at the time of cutting, how the desired garment will appear.

SUMMARY OF THE INVENTION

The present invention overcomes the above briefly described and other deficiencies and disadvantages of the prior art by facilitating the cutting of material from which garments are to be assembled. In accordance with the present invention, a pattern system is provided which makes it possible for garments to be easily made from material bearing a design by persons who are not experts.

The present invention includes a series of patterns which correspond to the garment which is to be made. The invention also includes means for forming reference marks along at least two adjacent edges of a length of fabric which is intended to be used for the production of the garment. The individual patterns of each series are provided with cross-markings which define at least two mutually perpendicular lines. The present invention further includes a positioning plan for the individual patterns. The individual patterns are represented on the positioning plan with their cross-markings aligned with the reference marks formed on or applied to adjacent sides of the length of material.

The present invention, as briefly described above, makes it possible to readily visualize, without any ambiguity, how the individual patterns must be placed on the length of material in order to achieve the desired result. The positioning of the pattern is accomplished by utilizing the reference marks and the lines of the cross-markings; the lines of the cross-markings being positioned so as to face the reference marks.

In accordance with a further feature of the present invention, the means for forming the reference marks along adjacent edges of a length of material can be in the form of a plate which is provided with reference marks along at least two adjacent edges.

Pursuant to an alternative embodiment of the invention, the means for forming the reference marks along two adjacent edges of a length of material may include the selvedges of the material which has been imprinted with the said reference marks.

In accordance with yet another alternative embodiment of the invention, the means for forming the reference marks along at least two adjacent edges of a length of material may take the form of a sheet which bears, on one face, symbols printed in a sublimable; i.e., a transferable; ink. For imparting a certain "style" to the fabric, the patterns themselves may comprise designs which are printed in a sublimable ink for transfer to a length of fabric.

In accordance with a further feature, each pattern of the pattern system is of the type which corresponds to a large size and comprises intermediate tracings which correspond to smaller sizes.

The present invention also comprises, in the interest of facilitating the formation of the garment, a fitting plan for the various pieces of fabric cut from the length of material in accordance with the patterns.

In accordance with one particular form of the invention, the different patterns are printed on a single sheet. The sheet which carries the different patterns may comprise symbols which are formed with a sublimable ink, these symbols constituting the means for forming reference marks along adjacent edges of the length of material.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENTS

Figure 1:
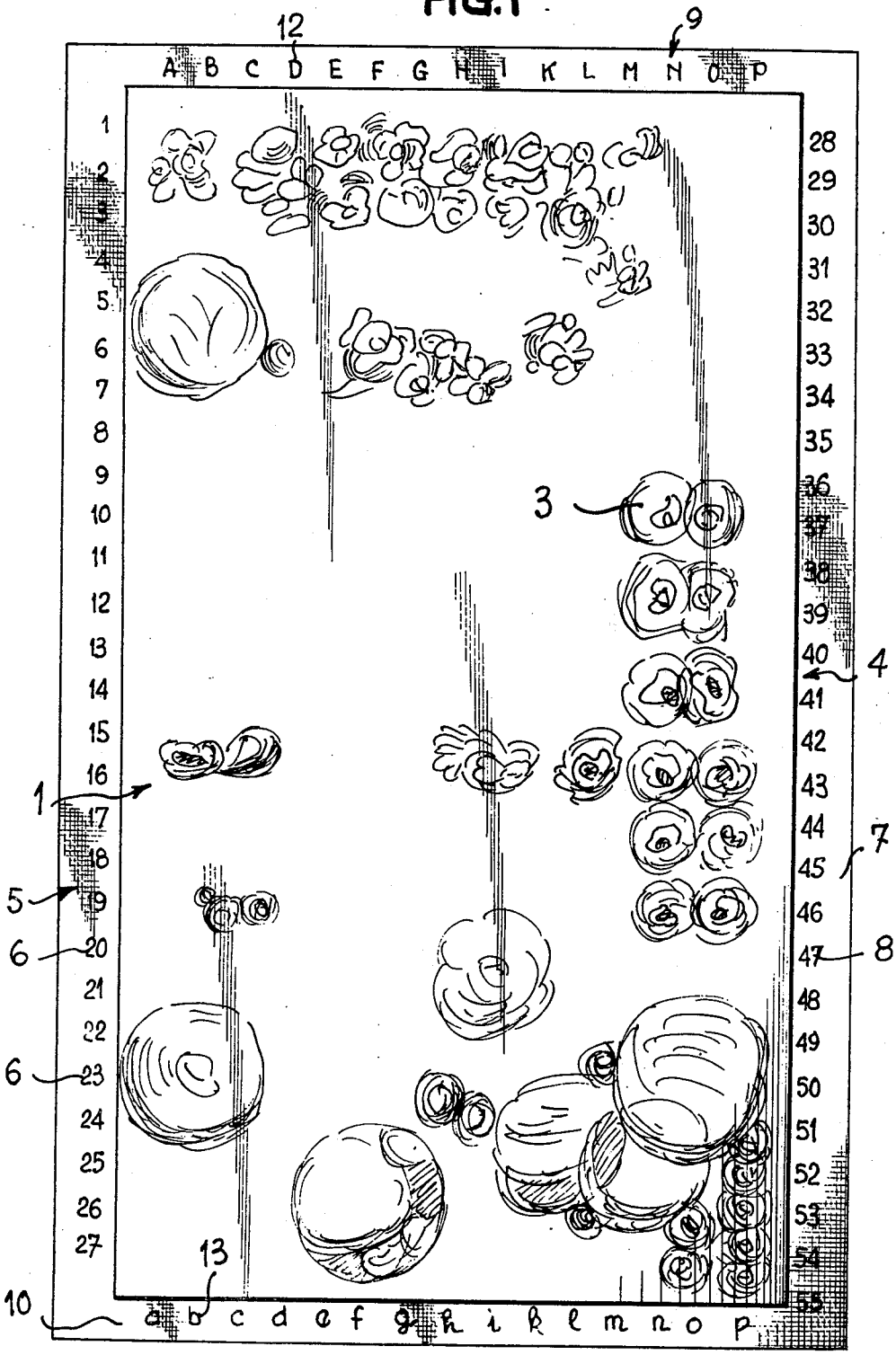
FIG. 1 is a plan view of a length of material from which a garment is to be formed.

With reference now to FIG. 1, a length of fabric material from which a dress is to be produced is indicated generally at 1. The fabric 1 is imprinted with a design 3 and is edged by a selvedge indicated generally at 4. The selvedge 4 has regularly spaced numerals imprinted thereupon, as indicated at 6 and 8, along the oppositely disposed long sides 5 and 4 of the material. The short sides 9 and 10 of selvedge 4, which interconnect the long sides 4 and 5, are respectively provided with regularly spaced indicia 12 and 13 in the form of letters.

Figure 3:
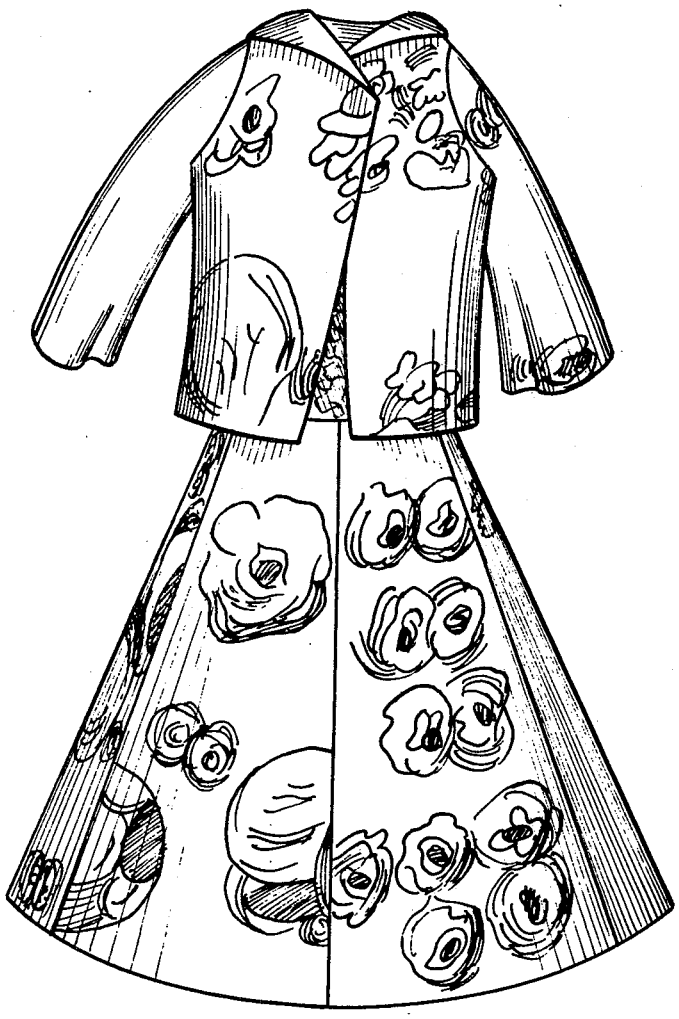
FIG. 3 is a sketch depicting how a dress fabricated from the material of FIG. 1 employing the patterns of FIG. 2 should look when assembled.

Employing the present invention, a seamstress with limited skill or experience will be able to assemble the dress depicted in FIG. 3 from length of material 1.

Figure 2:
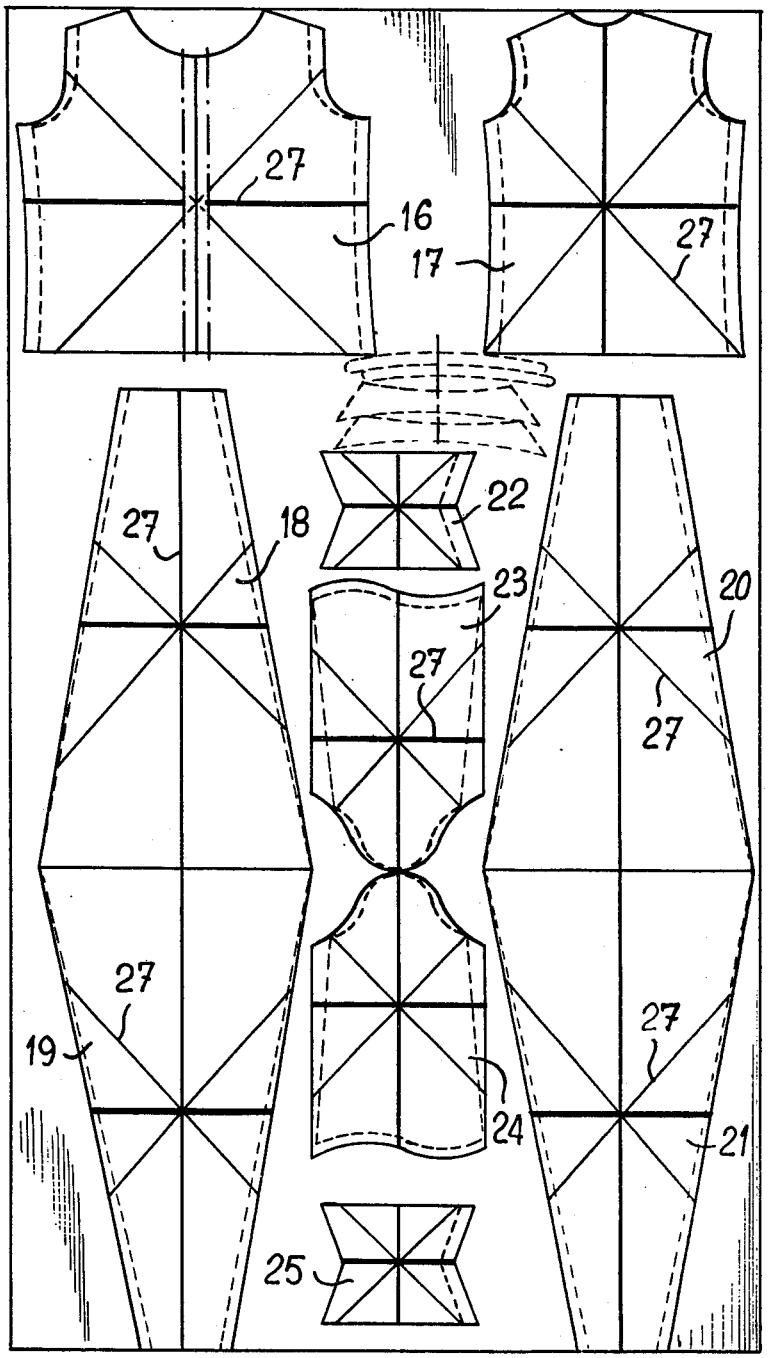
FIG. 2 depicts a sheet of patterns in accordance with the present invention.

FIG. 2 depicts a sheet, typically comprised of paper, on which are printed the patterns corresponding to the individual pieces which are assembled to produce the dress of FIG. 3. Each pattern is drawn in full lines corresponding to a large size such as, for example, the size 48. Printed within the solid lines are broken lines which correspond to smaller sizes. An individual utilizing the pattern will have to select the solid or broken line corresponding to the size garment to be produced and thereafter cut the sheet along the appropriate lines or reproduce the different patterns on transparent sheets in the appropriate size. Since an individual's measurements often do not correspond to a standard size, it is possible to choose the desired exact size on the different patterns corresponding to the different parts of the dress.

Continuing with a discussion of FIG. 2, the pattern sheet has imprinted thereon the patterns 16, 17, 18, 19, 20, 21, 22, 23, 24 and 25. The patterns 18–21 are provided for cutting out the panels of a skirt, the patterns 23 and 24 are provided for cutting out the right and left sleeves respectively, while the patterns 22 and 25 represent the cuffs. The pattern 16 corresponds to the front of the bodice while pattern 17 corresponds to the back.

Each of the ten patterns includes within its bounds printed guide lines in the form of a crossing pattern 27 which includes at least two mutually perpendicular lines. The guide lines 27, in the manner to be described below, facilitate the positioning of the different patterns on the length of material so as to produce a dress on which the designs on the fabric are placed in accordance with a particular harmonious lay-out.

Figure 4:
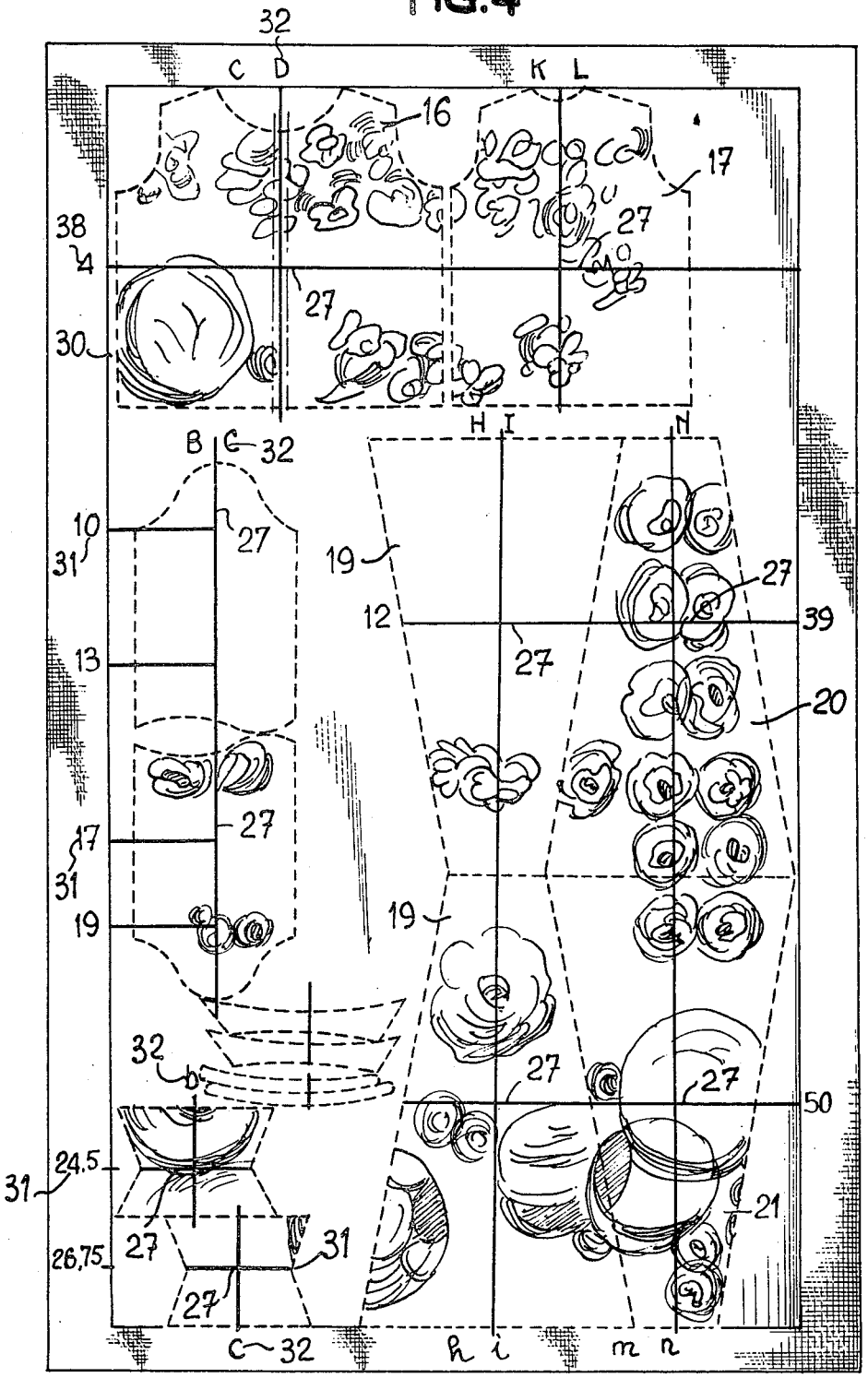
FIG. 4 is a pattern positioning plan in accordance with the present invention.

FIG. 4 is a positioning plan 30 for the individual patterns on the length of material 1 with the object of obtaining the dress which is shown in FIG. 3. The individual patterns 16–25 are represented on plan 30 with the guide lines 27 arranged as shown; i.e., a pair of perpendicular guide lines within each pattern are aligned with reference marks, as indicated at 31 and 32, which will be formed on adjacent sides of the length of material.

Figure 5:
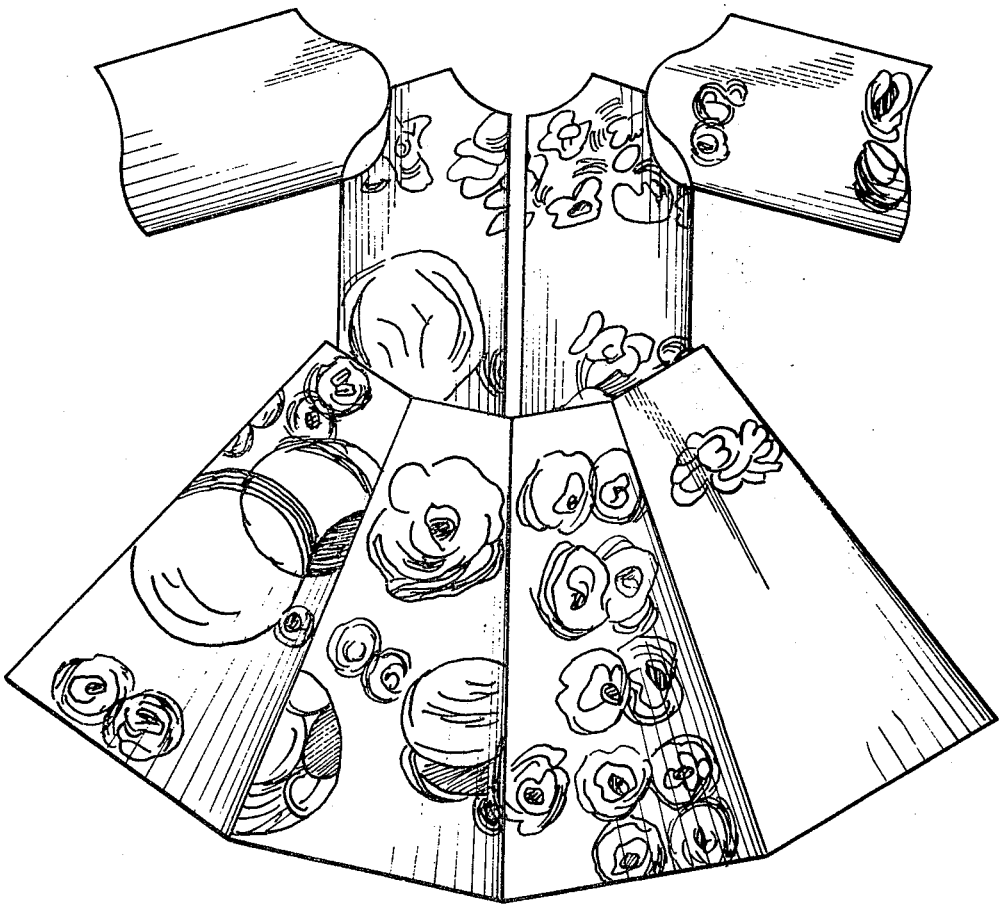
FIG. 5 is an assembly plan in accordance with the present invention.

FIG. 5 shows the various parts which have been cut out, in accordance with the patterns of FIG. 2, to define the pieces of material which will be assembled to form the dress of FIG. 3.

In order to produce a garment in accordance with the present invention, the patterns 16–25 of FIG. 2 are cut out or reproduced on transparent paper, commensurate with the desired size garment, either along the full lines or broken lines. Next, employing the positioning plan of FIG. 4, the individual patterns are positioned as indicated. By way of example, in positioning the pattern 16 corresponding to the front of the dress, the bar of the cross of guide lines 27 is aligned with the reference mark "4" on side 5 while the upright portion of the cross is aligned with the reference mark "D" on side 9. After correctly positioning the different patterns on the material in accordance with the arrangement provided on the plan of FIG. 4, the pieces of material will be cut out and these pieces will thereafter be assembled as the represented in FIG. 5.

Figure 6:
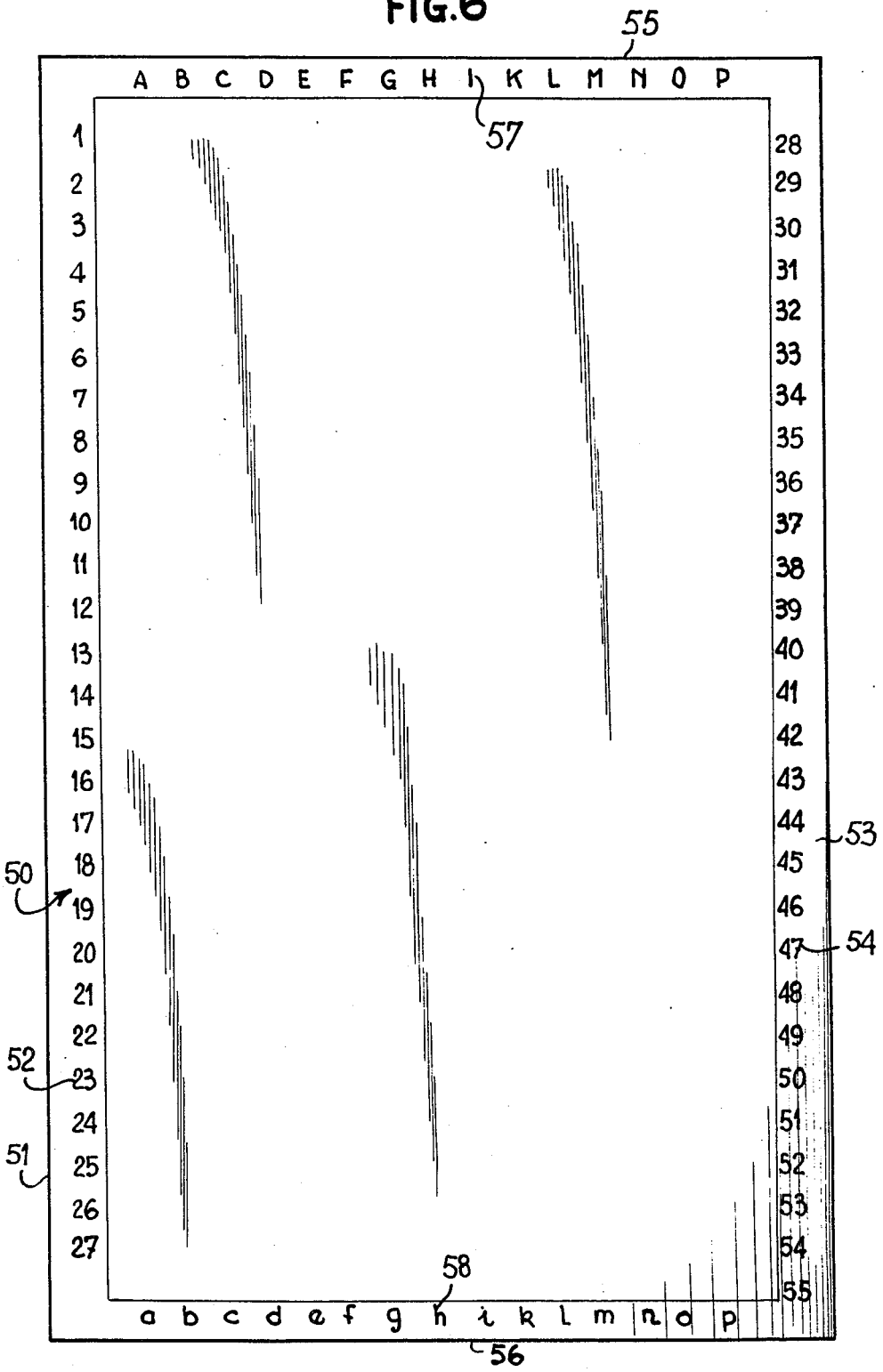
FIG. 6 is a plan view of a reference plate in accordance with the invention.

FIG. 6 shows a modified form of the invention in which a plate 50 of generally rectangular shape is provided. Plate 50 bears reference marks 52 and 54, respectively, along its long sides 51 and 53 and reference marks 57 and 58, respectively, along its short sides 55 and 56. Plate 50 will be larger than the length of material from which the pieces of the garment will be cut whereby the material may be placed on plate 50 for the cutting operation with the reference marks being visible about the edges of the material so as to facilitate the positioning of the patterns.

Figure 7:
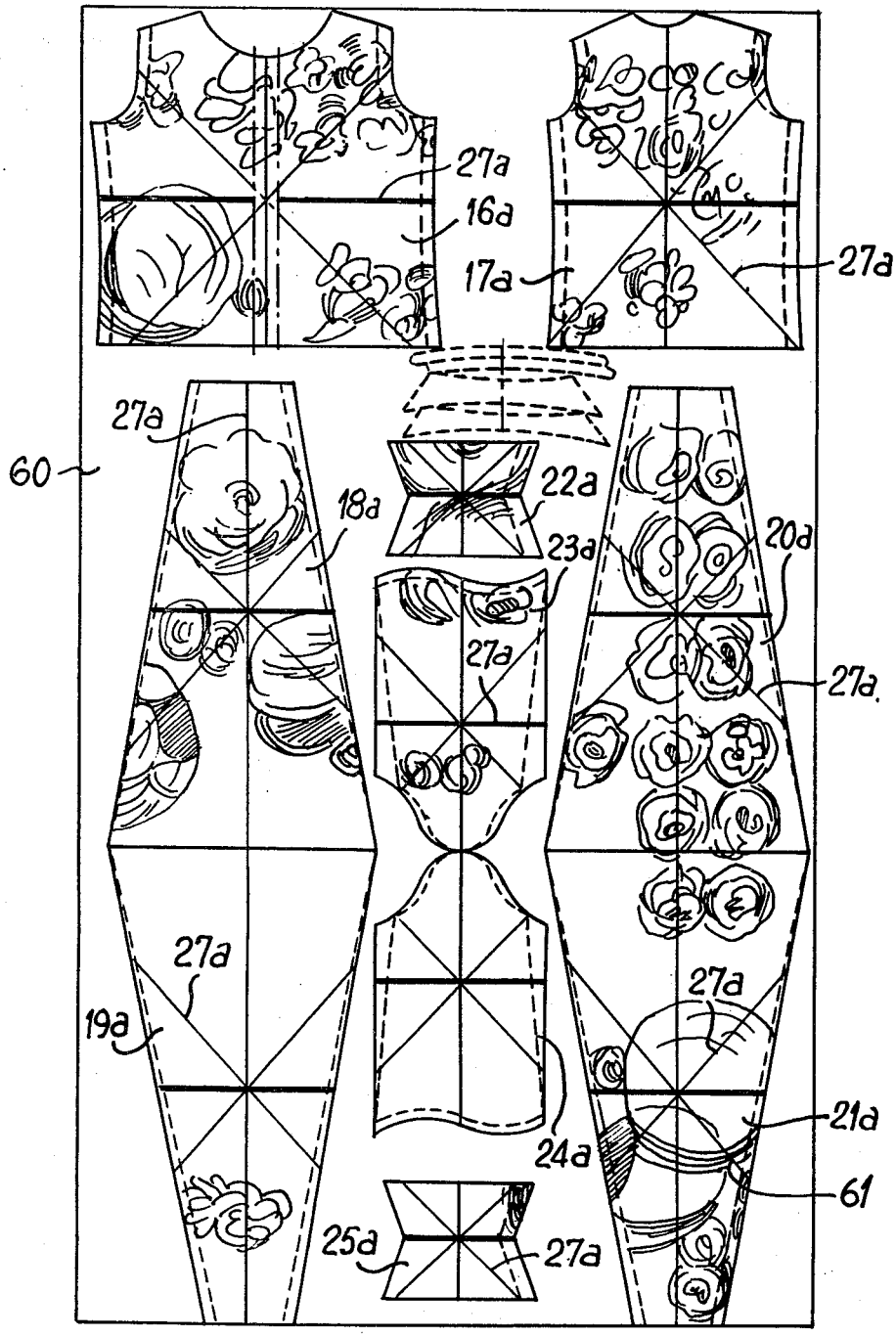
FIG. 7 depicts a pattern plate in accordance with a further embodiment of the invention.

Referring to FIG. 7, the patterns have been shown as having been traced on a sheet 60 and, in order to facilitate understanding of the embodiment of FIG. 7, it will be presumed that the dress to be made is the same as depicted in FIG. 3. The patterns 16*a*–25*a*, which correspond to the patterns 16–25 of FIG. 2, are printed on sheet 60. Each of the ten patterns includes the guide lines 27*a* designed to facilitate the positioning thereof on the length of material. The patterns also include, on the face thereof which is to be applied to the fabric, designs 61 which are printed in a sublimable ink. These designs are placed in such a manner that, when the dress will have been completed, they will be disposed in the same manner as in the example shown in FIG. 3. In utilizing the embodiment of FIG. 7, it is possible to employ the positioning plan 30 of FIG. 4. Alternatively, instructions may be provided for positioning each pattern in accordance with reference marks on a plate such as the plate 50 of FIG. 6.

For cutting out the dress, the first step will comprise the cutting out, following either the full or broken lines, of the several patterns. The length of material is positioned on plate 50 and, employing the plan of FIG. 4, the patterns are placed in position in such a manner as to align perpendicular guide lines 27*a* with the indicated reference marks. It is then possible either to cut out the material along the edges of the patterns and, while holding the patterns against the corresponding pieces, to transfer the design to the fabric by using a hot iron. Alternatively, the hot iron may be applied first to transfer the design by sublimation to the fabric and the pattern may thereafter be cut out. The pieces which are cut out and thus printed are then assembled in accordance with the plan of FIG. 5.

While preferred embodiments have been shown and described, various modifications and substitutions may be made thereto without departing from the spirit and scope of the invention. Thus, by way of example, it is possible to provide several positioning plans thereby permitting different garments or different decorations to be obtained from a single printed fabric. It is also possible, in accordance with the invention, to provide a pattern sheet having symbols provided along the edges of one face in the form of sublimable ink whereby the reference marks may be transferred to the fabric through the use of a heated iron. Accordingly, it will be understood that the present invention has been described by way of illustration and not limitation.

What is claimed is:

1. Apparatus for use in the manufacture of garments from material having an asymmetrical design thereon comprising:

means establishing reference markings along at least two adjacent sides of a length of material having an asymmetrical design thereon from which the garment is to be formed;

a plurality of patterns, said patterns each defining the shape of a different portion of the garment, said patterns including guide lines defined by at least two perpendicular crossing lines; and a positioning plan, said plan bearing representations of the patterns with perpendicular guide lines and having reference markings corresponding to those established along adjacent sides of the length of material, the perpendicular guide lines of a pair of lines within each pattern on the said plan being respectively aligned with the reference markings on the said plan which correspond to the markings established along adjacent sides of the length of material, the plane providing for positioning of a particular pattern on a particular portion of the material, said crossing lines defining a portion of the asymmetrical design to be included on the material defined by the pattern.

2. The apparatus of claim 1 wherein the means for establishing reference marks along two adjacent edges of a length of material comprises a plate provided with reference marks along two adjacent edges.

3. The apparatus of claim 1 wherein the means for establishing reference marks along two adjacent edges of a length of material comprises selvedges of the said length upon which the said reference marks are imprinted.

4. The apparatus of claim 1 wherein the means for establishing reference marks along two adjacent edges of a length of material comprises a transfer sheet including, on one face, symbols which are formed with a sublimable ink.

5. The apparatus of claim 1 wherein the patterns comprise designs formed with a sublimable ink.

6. The apparatus of claim 1 wherein each pattern of said plurality of patterns is of the type corresponding to a large size and comprises intermediate tracings corresponding to smaller sizes.

7. The apparatus of claim 1 further comprising:

an assembly plan of the different pieces of material cut out from the length of material in accordance with the said patterns.

8. The apparatus of claim 1 wherein the patterns of said plurality are printed on a single sheet.

9. The apparatus of claim 8 wherein the sheet carrying the different patterns further includes symbols formed with a sublimable ink, said symbols constituting the means for establishing reference marks along two adjacent edges of the length of material.

10. The apparatus of claim 3 wherein the patterns of said plurality are printed on a single sheet.

11. Apparatus for use in the manufacture of garments comprising:

a length of fabric having an asymmetrical design thereon and having along two adjacent edges a border having printed reference marks thereon;

a plurality of patterns each corresponding to the different pieces of the garment to be made, each pattern having at least two perpendicularly crossed reference lines; and a plan for placing the patterns on the fabric, the patterns being represented on the plan, and means on said plan to indicate the correspondence of the reference lines to the reference marks, the plan providing for positioning of a particular pattern on a particular portion of the material, said crossed lines defining a portion of the asymmetrical design to be included on the material defined by the pattern.

* * * * *